US012318832B2

(12) United States Patent
Reyes

(10) Patent No.: US 12,318,832 B2
(45) Date of Patent: Jun. 3, 2025

(54) DIE ASSEMBLY TOOL

(71) Applicant: Honeywell Federal Manufacturing & Technologies, LLC, Kansas City, MO (US)

(72) Inventor: Joseph Reyes, Gladstone, MO (US)

(73) Assignee: Honeywell Federal Manufacturing & Technologies, LLC, Kansas City, MO (US)

( * ) Notice: Subject to any disclaimer, the term of this patent is extended or adjusted under 35 U.S.C. 154(b) by 468 days.

(21) Appl. No.: 17/527,793

(22) Filed: Nov. 16, 2021

(65) Prior Publication Data

US 2023/0150007 A1 May 18, 2023

(51) Int. Cl.
*B21D 37/14* (2006.01)

(52) U.S. Cl.
CPC ..... *B21D 37/14* (2013.01)

(58) Field of Classification Search
CPC ..... B21D 37/04; B21D 37/14; B23Q 3/04; B23Q 3/10; B23Q 16/001; B23Q 3/1556–15573; B25B 27/22; B25C 11/00; B60B 29/001; B60B 29/002; B60B 29/003; B60B 2900/541; B60B 30/02; B62B 1/14; B62B 1/26; B62B 5/025; B62B 2203/20; B62B 2203/30; B66F 15/00; E04F 21/0023; E04G 23/08; E04G 2023/085; H01F 7/206; H02G 3/283; Y10T 29/49822; Y10T 29/53896
USPC ..... 72/481.1, 466–467
See application file for complete search history.

(56) References Cited

U.S. PATENT DOCUMENTS 171,451 A * 12/1875 Viall et al. ..... B62B 1/264 280/47.27
1,438,334 A * 12/1922 Sabin ..... B62B 1/264 248/129
2,764,420 A * 9/1956 Morrissy ..... B62B 1/264 280/47.24
4,650,197 A * 3/1987 Norris ..... B62B 5/025 188/176
4,843,704 A * 7/1989 Sakamoto ..... B21D 37/145 83/559
10,058,911 B2 * 8/2018 Ahlemeyer ..... B21J 15/36
10,987,772 B2 * 4/2021 Takiguchi ..... B23Q 3/157
(Continued)

FOREIGN PATENT DOCUMENTS

CN 206445064 U 8/2017
CN 210125683 U 3/2020
CN 210754789 U 6/2020

*Primary Examiner* — Adam J Eiseman
*Assistant Examiner* — Fred C Hammers
(74) *Attorney, Agent, or Firm* — Hovey Williams LLP

(57) ABSTRACT

A tool for handling a die assembly, the tool including a rocker and a swivel. The rocker includes a foot and a backrest. The foot engages a base of the die assembly when the tool is upright and stabilizes the die assembly as the tool is leaned from being upright to reclined. The backrest extends vertically from the foot when the tool is upright. The swivel supports an outer shell and other components of the die assembly on the backrest and translates and rotates relative to the backrest when the tool is reclined to rotate the outer shell and other components from an inverted orientation to a non-inverted orientation. The foot stabilizes the die as the tool is leaned from being reclined to upright and can be moved horizontally out of engagement with the base when the tool is upright.

17 Claims, 10 Drawing Sheets

(56) References Cited

U.S. PATENT DOCUMENTS

| | | | | |
|---|---|---|---|---|
| 2004/0253086 | A1* | 12/2004 | Dixon | B62B 1/12 414/490 |
| 2007/0292247 | A1* | 12/2007 | Wilson | B62B 3/104 24/69 ST |
| 2021/0078122 | A1* | 3/2021 | Kraft | B23P 17/02 |
| 2021/0276795 | A1* | 9/2021 | Fraser | B62B 1/14 |

* cited by examiner

DIE ASSEMBLY TOOL

GOVERNMENT INTERESTS

This invention was made with Government support under Contract No.: DE-NA-0002839 awarded by the United States Department of Energy/National Nuclear Security Administration. The Government has certain rights in the invention.

BACKGROUND

Die assemblies often include several heavy parts that are difficult to handle properly. More particularly, preparing a die assembly for processing, including manipulating its parts for material loading, creates significant risk of injury and damage to the die assembly, work structures, and process machinery. To make these tasks easier, makeshift clamps are often used to keep the parts together and to provide gripping points and leverage. Unfortunately, the clamps themselves are unwieldy, and their general-purpose construction may create a false sense of secureness between the clamps and the die assembly, which perpetuates the risk of injury or damage to the die assembly, work structures, and process machinery.

SUMMARY OF THE INVENTION

Embodiments of the present invention solve the above-mentioned problems and provide a distinct advance in the art of die assembly tools. More particularly, the present invention provides a die assembly tool (hereinafter "tool") that minimizes or eliminates the physical difficulties in handling die assembly parts during preparation for processing.

An embodiment of the invention is a die assembly tool broadly comprising a rocker and a swivel. The tool facilitates a controlled reconfiguration of die assembly parts via particular manipulations of the rocker and swivel.

The rocker includes a foot, a backrest, and a chamfered surface. The rocker (and hence the tool) is configured to be in an upright orientation, a tilted orientation, and a reclined orientation.

The foot includes left and right arms, left and right handles, a through-slot, and a groove and is configured to engage a base of the die assembly. The foot has sufficient width and depth to support the tool itself in the upright orientation. The foot may include an adapter for accommodating bases of different sizes.

The left and right arms extend laterally outward (when the tool is in the upright orientation) for embracing the base. To that end, the left and right arms extend in an arc complementary to the shape of a base of the die assembly. The left and right arms include an inwardly-facing beveled ledge for engaging the bevel of the base.

The left and right handles are positioned horizontally on sides of the foot. The left and right handles include grip material or geometry for improving a user's grip thereon.

The through-slot extends laterally through the foot and is configured to receive a circumferential strap therethrough. The through-slot is positioned at a height from a bottom of the foot so that a strap fed through the through-slot can encircle the base without any twisting, curling, or localized side-loading of portions the strap.

The groove extends from a bottom side of the foot, along the chamfered surface, and up a back side of the backrest for receiving a strap encircling the die assembly in a vertical plane.

The backrest extends vertically from the foot and includes a slot, left and right handles, and portions of the groove described above. The backrest has sufficient width and depth to balance the tool itself and an outer shell, female component, and male component of the die assembly in the reclined position without tipping over.

The slot extends vertically (when the tool is in the vertical orientation) on a front face of the backrest. The slot is configured to guide movement of the slider of the swivel.

The left and right handles of the backrest are positioned vertically on sides of the backrest. The left and right handles include grip material or geometry for improving a user's grip thereon.

The chamfered surface extends diagonally from the foot to the backrest at an angle of between approximately 1 degree and 89 degrees, more preferably between 20 degrees and 70 degrees, and most preferably between approximately 26 degrees and 60 degrees. The chamfered surface connects to a bottom surface of the foot via an edge and to the rear surface of the backrest via a filleted surface.

The edge is a well-defined boundary between the chamfered surface and the bottom surface of the foot. This allows the tool to be leaned from the upright orientation to the tilted orientation via the edge as a fulcrum. The well-defined boundary facilitates initial leaning to verify that components of the die assembly and tool are well-supported and assembled properly.

The fillet is a curved surface between the chamfered surface and the rear surface of the backrest. This allows the tool to be leaned from the tilted orientation to the reclined orientation via the fillet as a fulcrum. The curvature of the fillet (compared to a well-defined edge) facilities gradual leaning (e.g., rolling) the tool from the tilted orientation to the reclined orientation and from the reclined orientation to the tilted orientation.

The swivel includes a slider, a bearing, and a cradle. The swivel is configured to support the outer shell, female component, and male component of the die assembly as they are maneuvered when the tool is in the reclined orientation. The swivel may also include an adapter for accommodating die assembly components of different sizes.

The slider resides in the groove and is configured to translate toward and away from the foot. The slider may be interlocked with the groove so that the slider 40 cannot easily be dislocated from the groove.

The bearing pivotably connects the cradle to the slider. The bearing may be a ball bearing, fluid bearing, plain bearing, or the like.

The cradle includes left and right arms and is pivotably connected to the slider via the bearing. The cradle thereby also is configured to translate with the slider toward and away from the foot.

The left and right arms of the backrest extend laterally outward (when the tool is in the upright orientation) for embracing an outer shell of the die assembly. To that end, the left and right arms extend in an arc complementary to the shape of the outer shell.

In use, the tool may be maneuvered toward the die assembly (with the die assembly in an inverted configuration) such that the left and right arms of the foot are against the base and such that the backrest is against the outer shell. The beveled ledge of the foot should engage a bevel of the base. A strap may then be inserted into the through-slot, passed around the base, and cinched or fastened to secure the base to the foot.

The rocker may then be leaned from the upright orientation to the tilted orientation via the left and right handles of the foot or backrest. The rocker may be tilted an initial amount to verify the die assembly is fully supported by the tool. In the tilted orientation, the tool should be balanced on the chamfered surface. With the tool in the tilted orientation, another strap may be passed in a vertical loop to encircle the tool and die assembly via the slot and cinched or fastened to secure the die assembly to the tool.

The rocker may then be leaned from the tilted orientation to the reclined orientation via the filleted surface. The outer shell should be resting entirely on the cradle when the rocker is in the reclined orientation. The strap encircling the tool and die assembly may then be at least partially loosened or unfastened.

The slider may then be moved in the groove away from the foot such that the outer shell, female component, and male component are spaced from the base. The cradle may then be rotated a half turn via the bearing such that the outer shell, female component, and male component are in a non-inverted orientation (i.e., a processing orientation) and hence the die assembly is in a non-inverted configuration. The slider may then be moved in the groove toward the foot such that the outer shell is against the base.

The strap previously encircling the tool and die assembly may then be cinched or fastened again to resecure the die assembly to the tool. The rocker may then be leaned from the reclined orientation to the tilted orientation. The tool and die assembly may then be lifted and carried to a processing machine or other location via the handles.

The rocker may then be leaned from the tilted orientation to the upright orientation. The straps may then be removed from the tool and from around the die assembly, and the tool may be moved away from the die assembly.

The above-described invention provides several advantages. For example, the tool secures the die assembly as the die assembly is leaned to the reclined orientation. The die assembly can be safely switched between its inverted configuration and non-inverted configuration without having to provide a lifting force. The tool does not require cumbersome clamps yet can accommodate die assemblies of different sizes. The tool can also be used to carry the die assembly.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
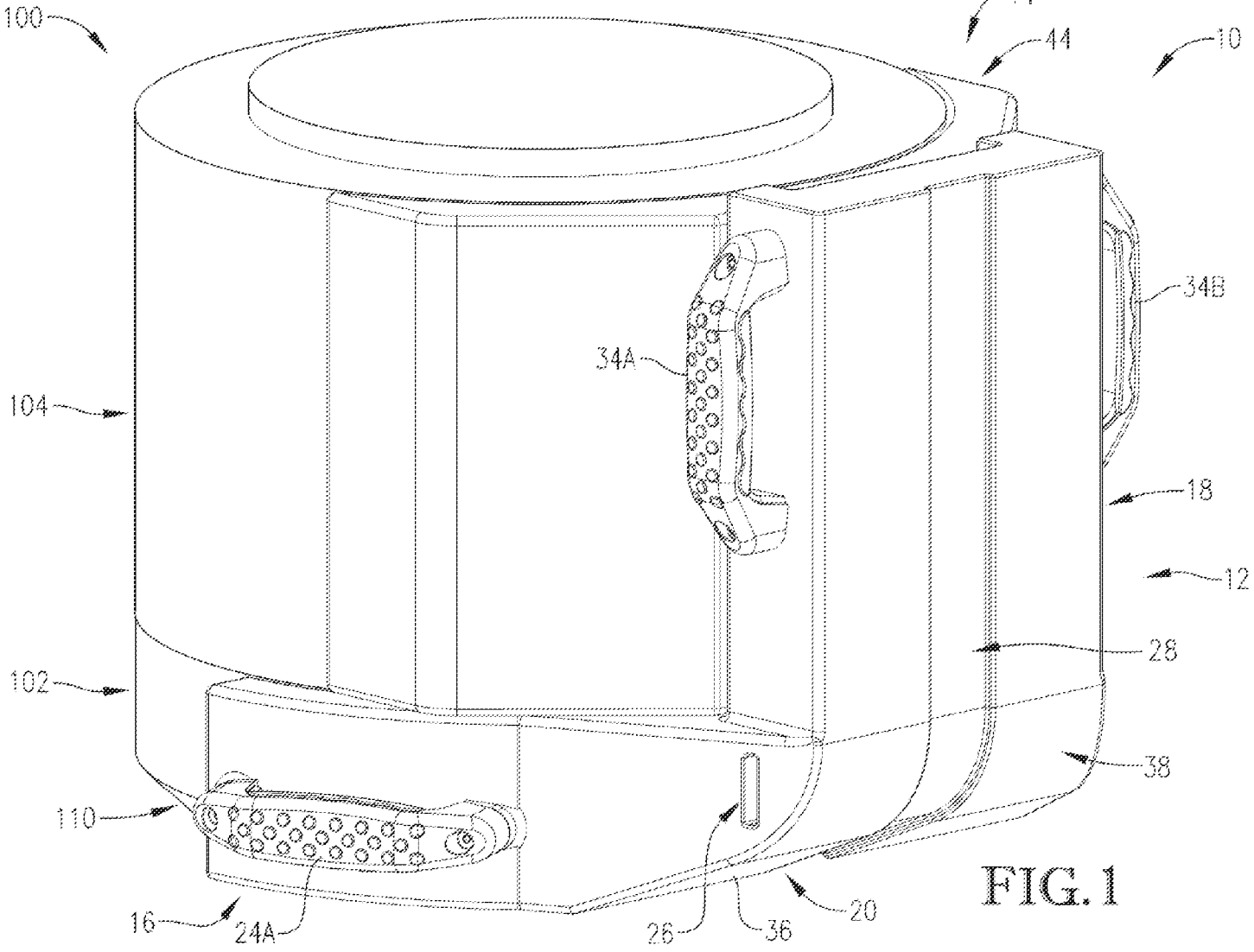
FIG. 1 is a rear perspective view of a die assembly tool constructed in accordance with an embodiment of the invention.
Figure 2:
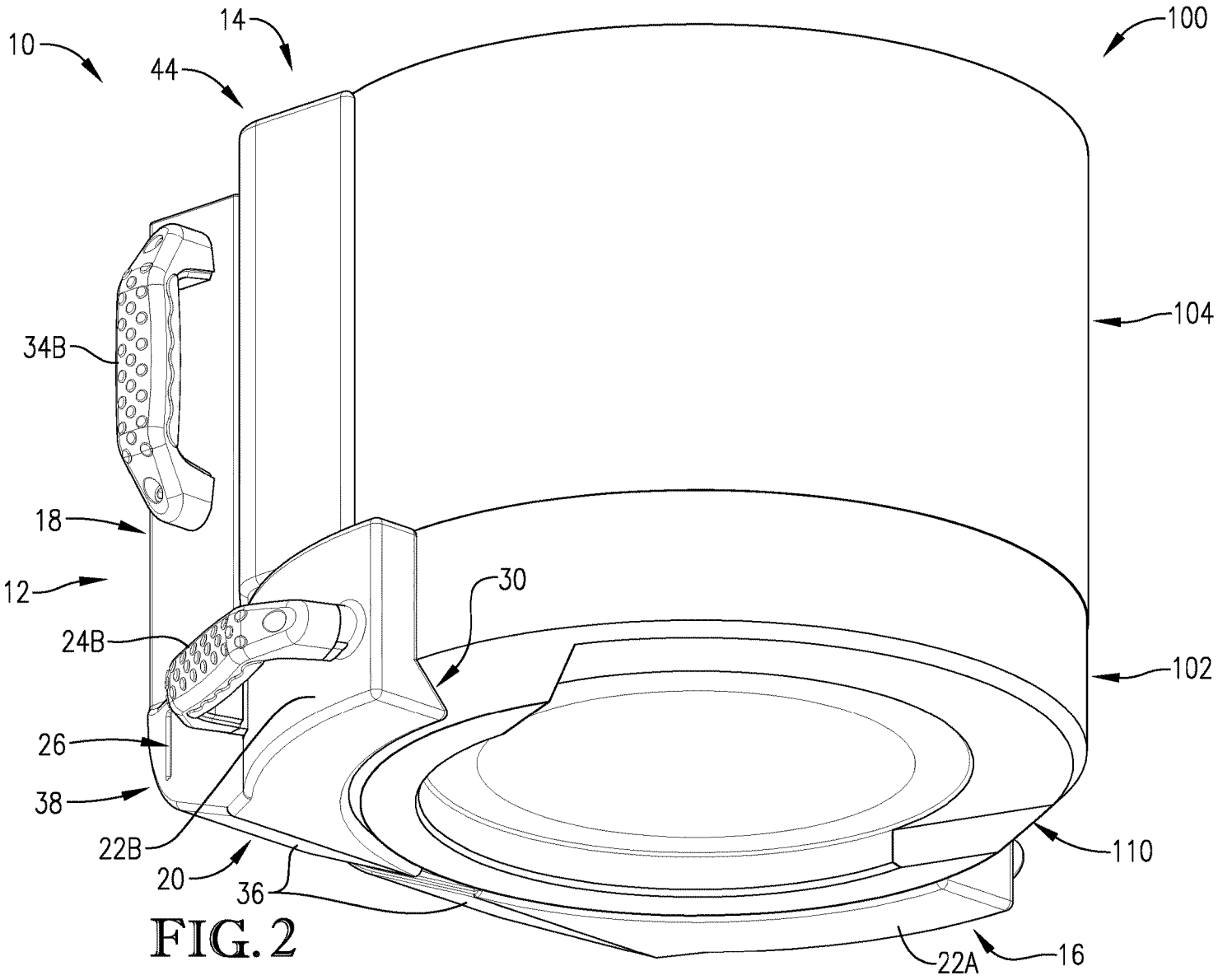
FIG. 2 is a bottom perspective view of the die assembly tool of FIG. 1.
Figure 3A:
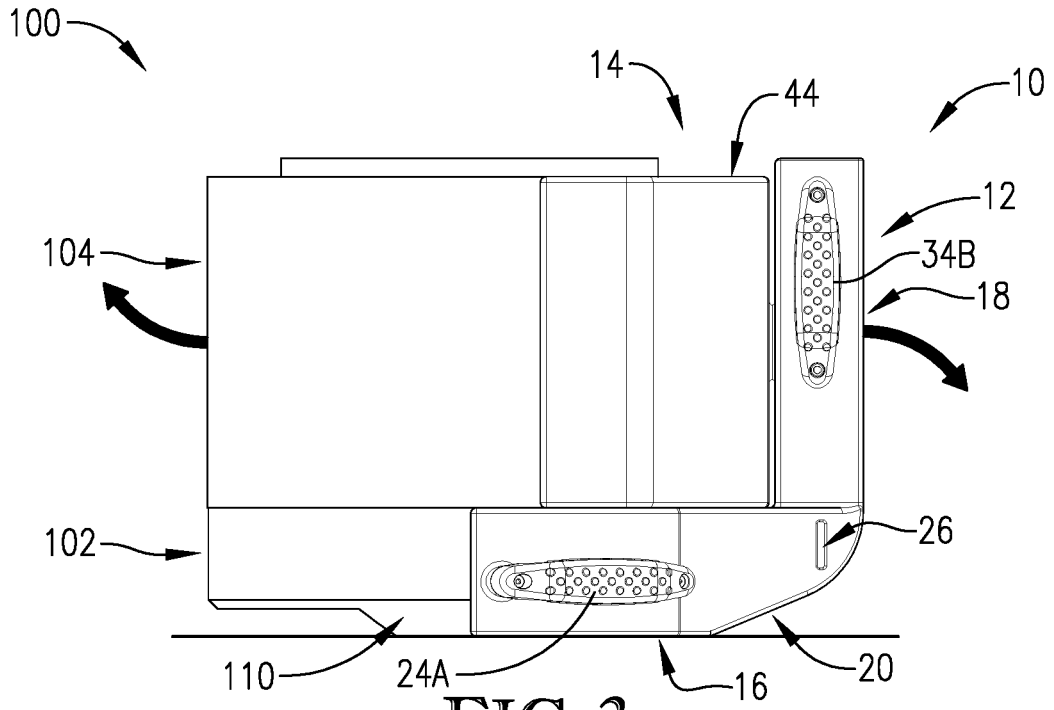
Figure 3B:
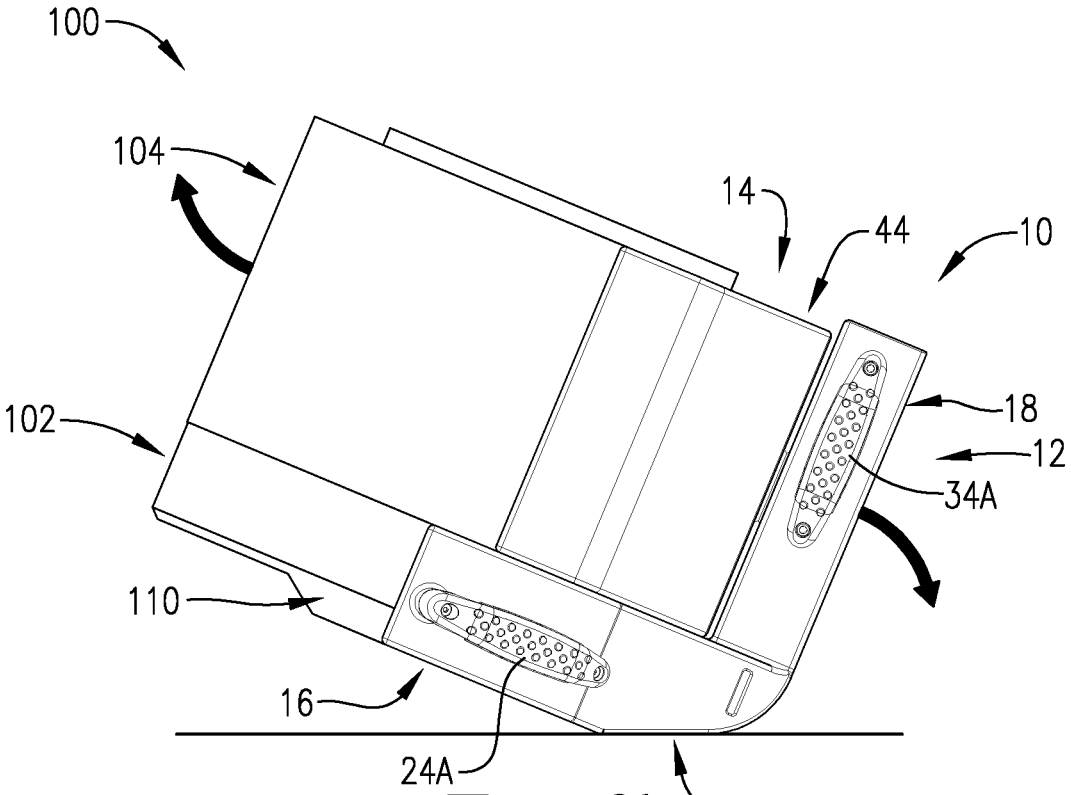
Figure 3C:
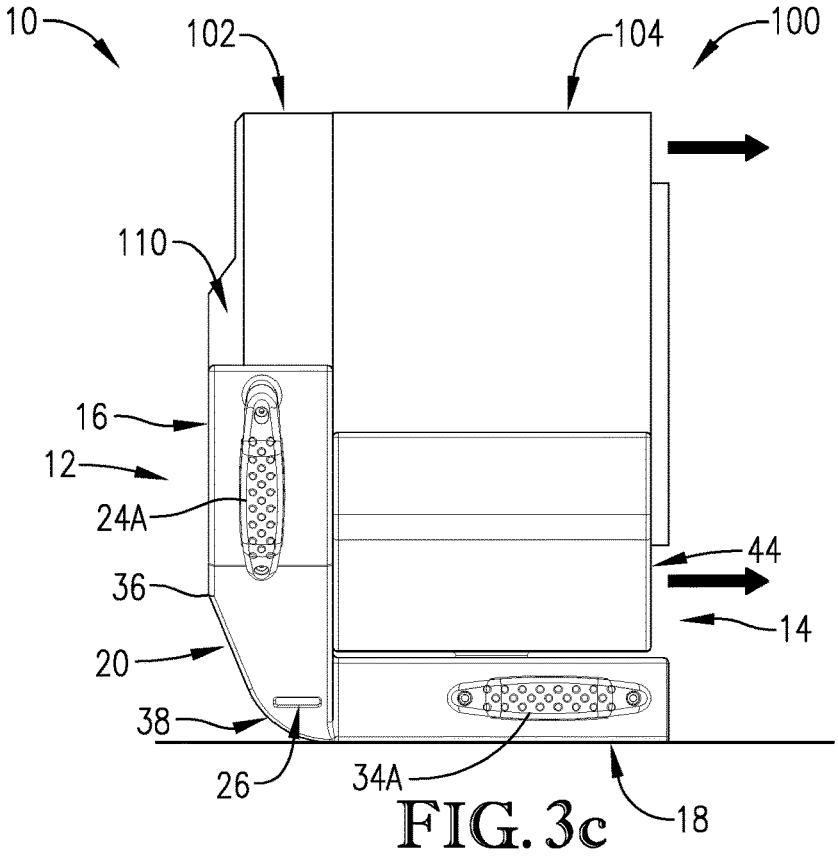
Figure 3D:
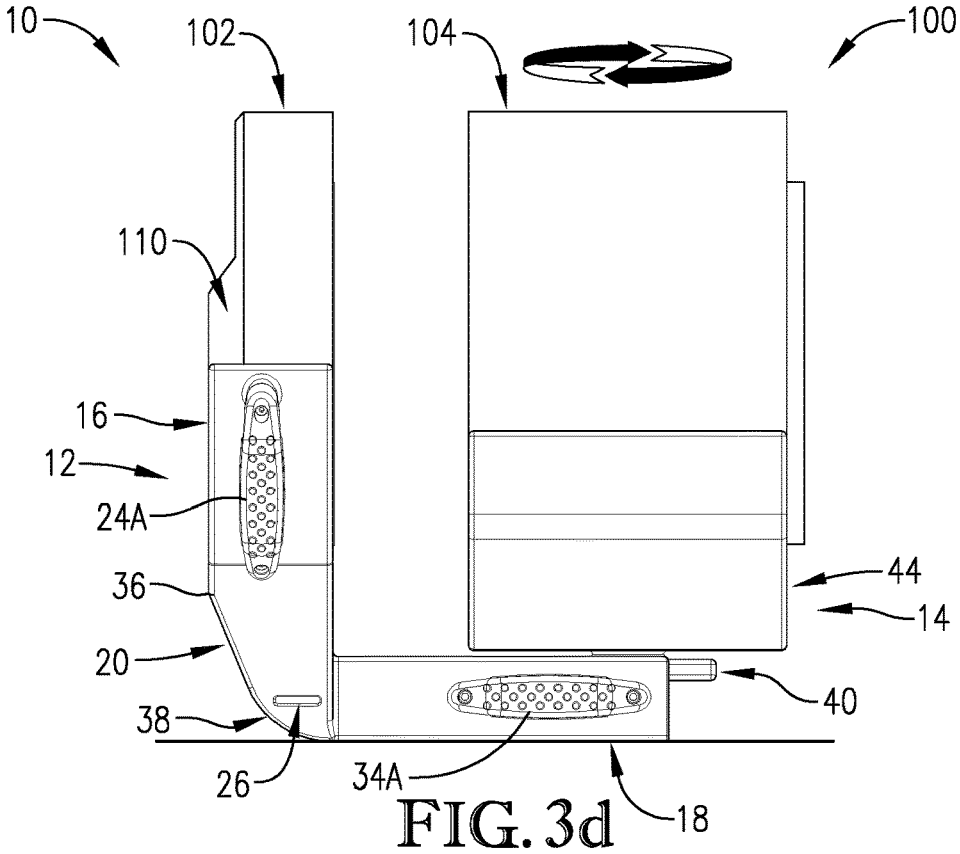
Figure 4:
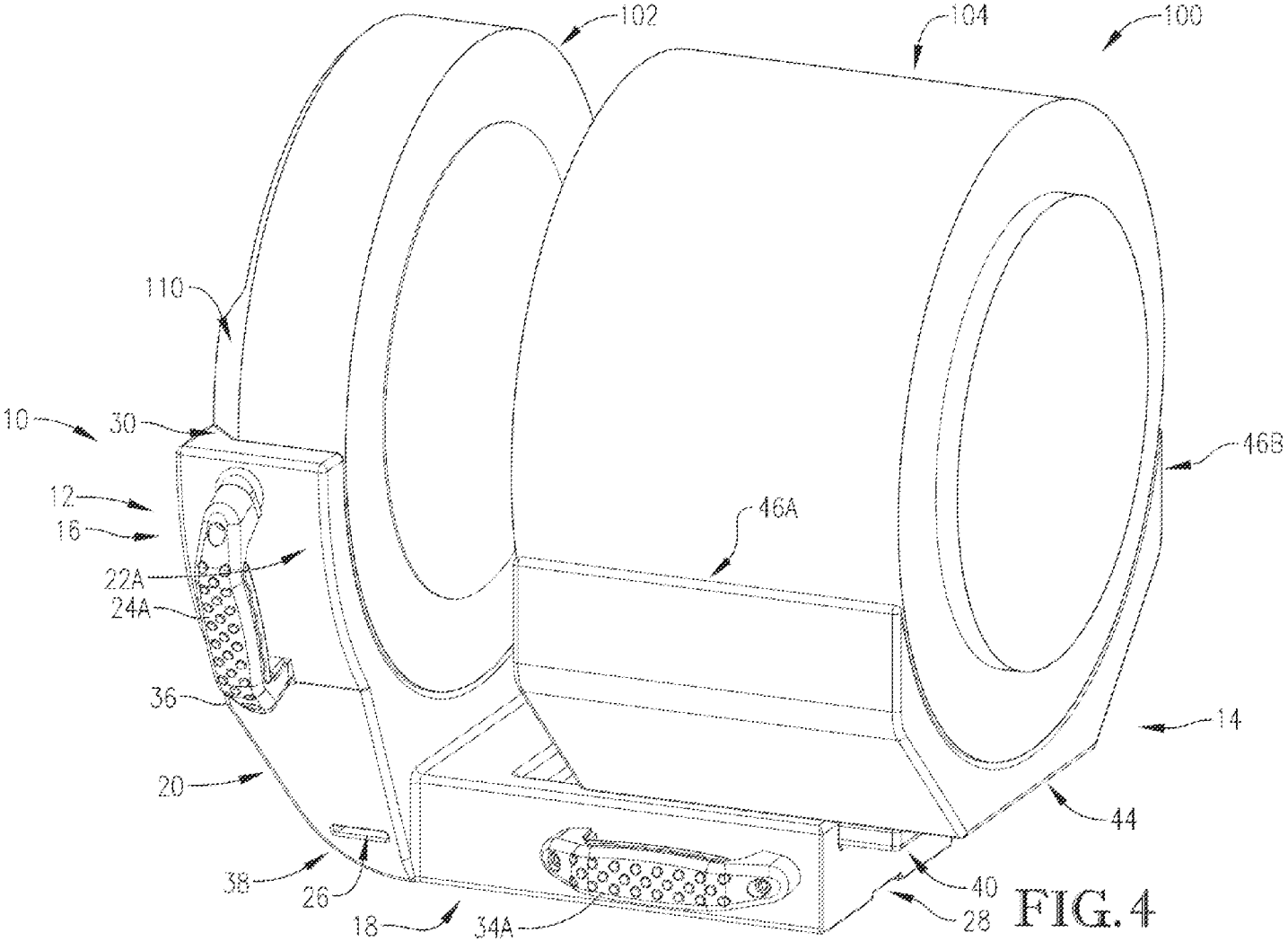
Figure 5:
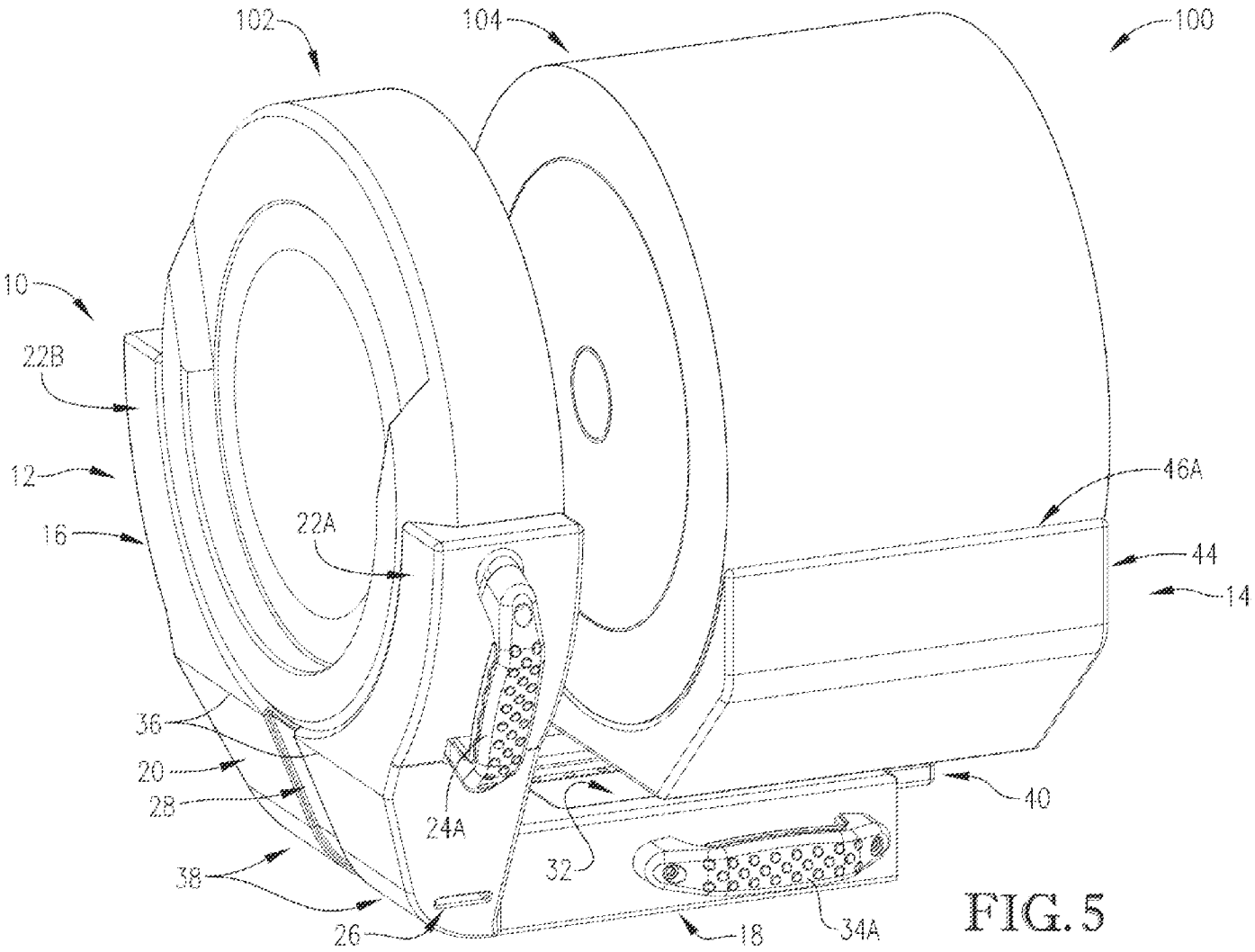
Figure 6:
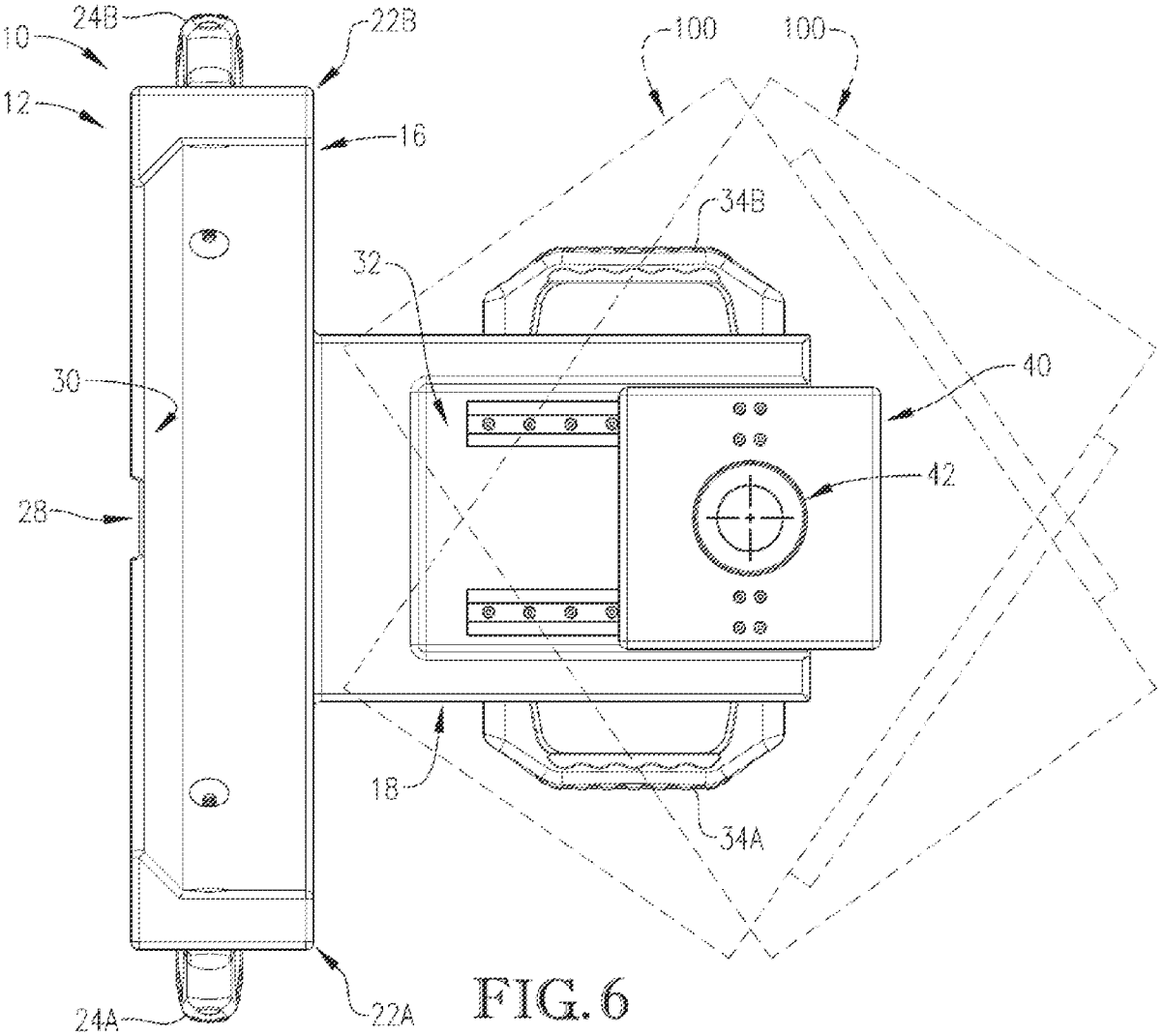
Figure 7:
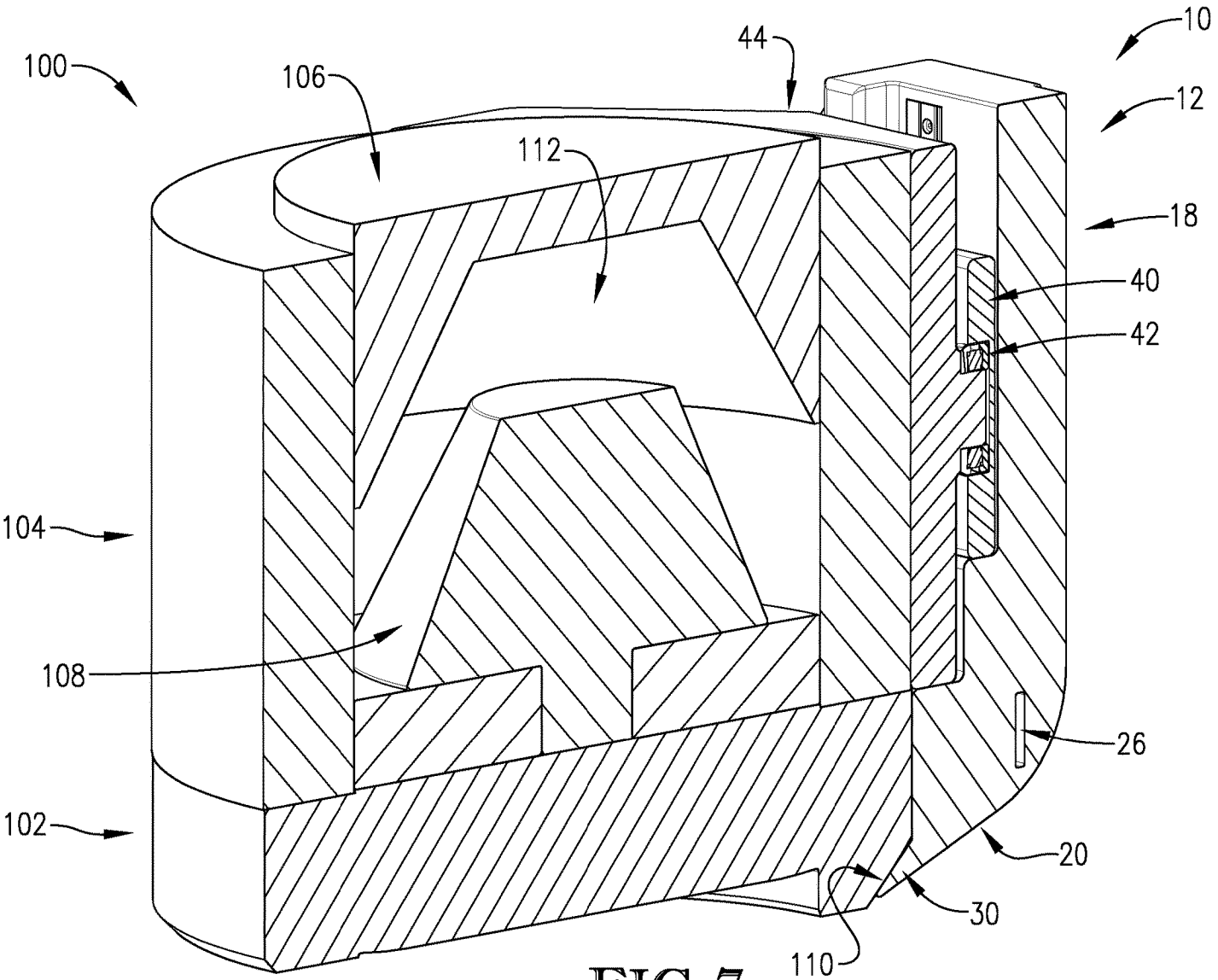
Figure 8:
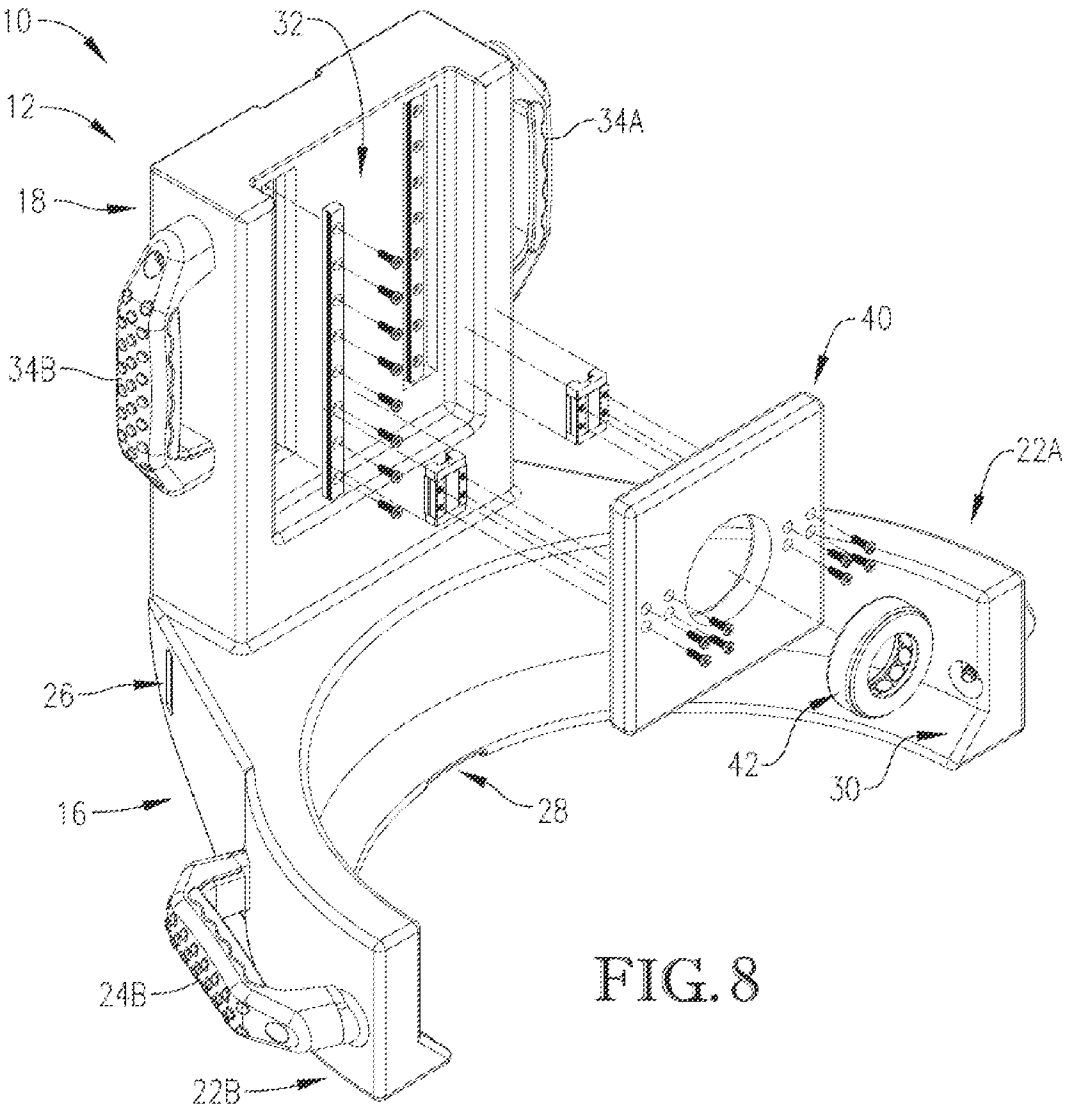

FIG. 3*a* is side elevation view of the die assembly tool of FIG. 1 in an upright orientation;

FIG. 3*b* is a side elevation view of the die assembly tool of FIG. 1 in a tilted orientation;

FIG. 3*c* is a side elevation view of the die assembly tool of FIG. 1 in a reclined orientation;

FIG. 3*d* is another side elevation view of the die assembly tool of FIG. 1 in the reclined orientation;

FIG. 4 is a perspective view of the die assembly tool of FIG. 1 in the reclined orientation;

FIG. 5 is another perspective view of the die assembly tool of FIG. 1 in the reclined orientation;

FIG. 6 is a top plan view of the die assembly tool of FIG. 1;

FIG. 7 is a cutaway perspective view of the die assembly tool of FIG. 1;

FIG. 8 is an exploded view of the die assembly tool of FIG. 1; and

Figure 9:
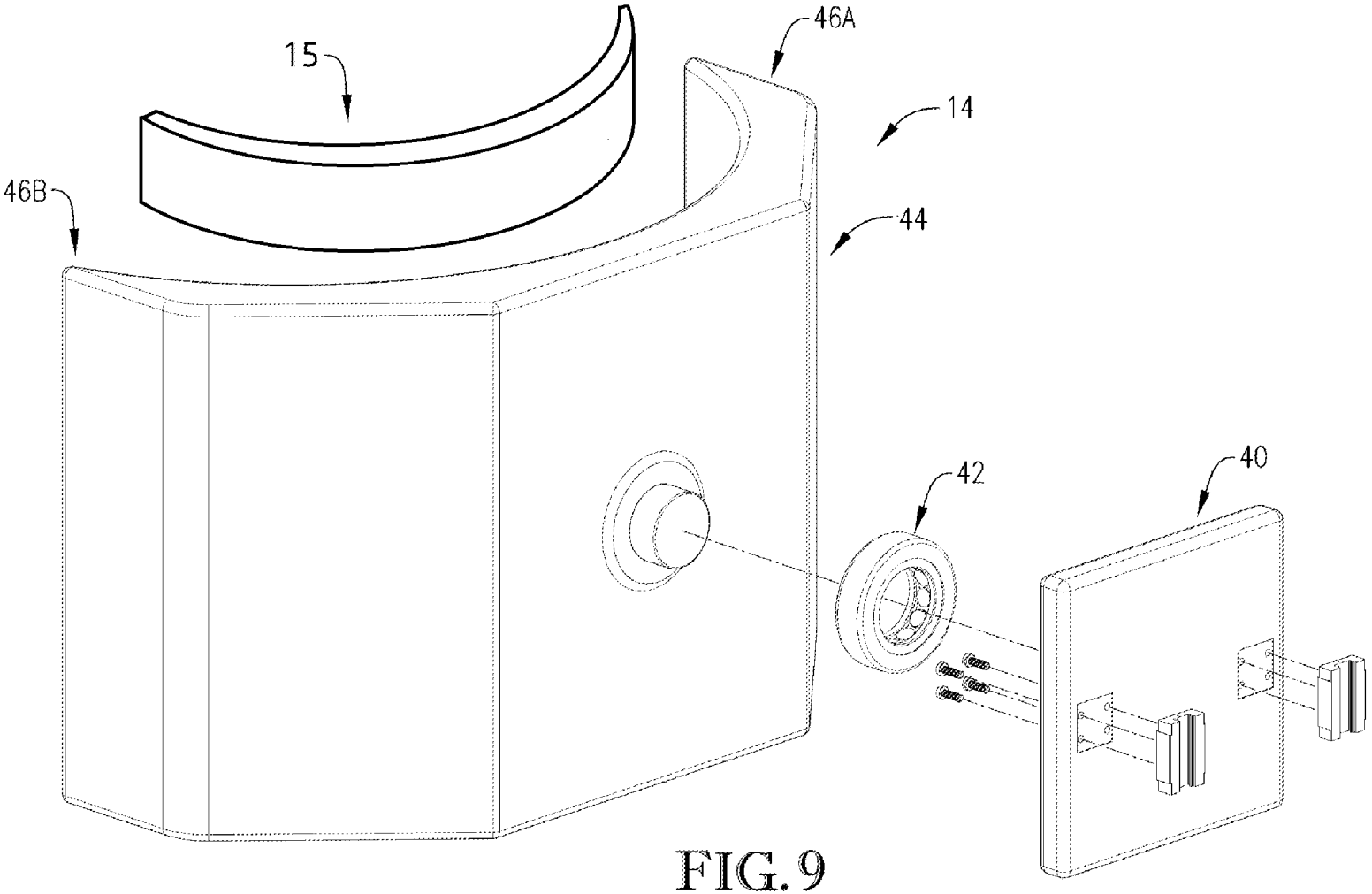

FIG. 9 is an exploded view of certain components of the die assembly tool of FIG. 1.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning to the drawing figures, a tool 10 constructed in accordance with an embodiment of the invention is illustrated. The tool 10 broadly comprises a rocker 12 and a swivel 14. The tool 10 may be used for handling and manipulating a die assembly 100.

The die assembly 100 may include a base 102, an outer shell 104, a female component 106, and a male component 108, as best seen in FIG. 7. The die assembly 100 may weigh between approximately 50 pounds and 200 pounds. In one embodiment, the die assembly 100 weighs approximately 120 pounds. The die assembly 100 may be substantially cylindrical and may have a diameter of approximately 14 inches. The die assembly 100 may also have few or no features conducive to direct handling. The base 102, outer shell 104, female component 106, and male component 108 also are not interconnected or restrained to each other. These factors make preparing the die assembly 100 for processing difficult. Furthermore, it may be imperative that the die assembly 100 not be scratched or damaged.

The base 102 may be circular or disc-shaped and supports the outer shell 104, female component 106, and male component 108. The base 102 may include a circumferential, inwardly-angled beveled surface 110, which is configured to be engaged by the foot 16 of the rocker 12. An outer diameter of the base 102 may be equal to an outer diameter of the outer shell 104.

The outer shell 104 may be an open-ended, cylindrical wall configured to encircle the female component 106 and male component 108. The outer shell 104 may have alignment geometry, guides, and other features for ensuring the outer shell, female component 106, and male component 108 are assembled correctly. An outer diameter of the outer shell 104 may be equal to an outer diameter of the base 102.

The female component 106 fits within one end of the outer shell 104 opposite the male component 108 and may include molding geometry for forming portions of an article. The female component 106 may also include generally concave geometry complementary of the male component 108.

The male component 108 fits within one end of the outer shell 104 opposite the female component 106 and may include molding geometry for forming other portions of the article. The male component 108 may also include generally convex geometry complementary of the female component 106.

The outer shell 104, female component 106, and male component 108 cooperatively form an inner molding chamber 112 configured to receive molding material for forming the article. The tool 10 described herein facilitates loading the molding material in the inner molding chamber 112 and reorienting the die assembly 100 for molding.

The rocker 12 broadly comprises a foot 16, a backrest 18, and a chamfered surface 20. The rocker 12 may have an L-shaped profile. The rocker 12 (and hence the tool 10) may be configured to be in an upright orientation, a tilted orientation, and a reclined orientation. The rocker 12 is configured to engage the base 102 of the die assembly 100 when the tool 10 is in an upright orientation and stabilize the die assembly 100 as the tool 10 is leaned from the upright orientation to a reclined orientation via a tilted orientation, as discussed in more detail below.

The foot 16 may include left and right arms 22A,B, left and right handles 24A,B a through-slot 26, and a groove 28. The foot 16 has sufficient width and depth to support the tool 10 itself in the upright orientation. The foot 16 may include an adapter for accommodating bases of different sizes.

The left and right arms 22A,B extend laterally outward (when the tool 10 is in the upright orientation) for embracing the base 102. To that end, the left and right arms 22A,B may extend in an arc (in one embodiment, a circular arc) in a C-shape or other shape complementary to the shape of the base 1-2. The left and right arms 22A,B may also include an inwardly-facing beveled ledge 30 for engaging the bevel 110 of the base 102.

The left and right handles 24A,B may be positioned horizontally on sides of the foot 16 and may be integral components or separate fastened pieces. The left and right handles 24A,B may include grip material or geometry for improving a user's grip thereon.

The through-slot 26 extends laterally through the foot 16 and is configured to receive a circumferential strap therethrough. The through-slot 26 may be positioned at a height from a bottom of the foot 16 so that a strap fed through the through-slot 26 can encircle the base 102 without any twisting, curling, or localized side-loading of portions the strap.

The groove 28 extends from a bottom side of the foot 16, along the chamfered surface 20, and up a back side of the backrest 18 and is configured to receive a strap encircling the die assembly 100 in a vertical plane. The strap positioned in the through-slot 26 and the strap positioned in the groove 28 cooperatively secure the die assembly 100 to the tool 10.

The backrest 18 extends vertically from the foot 16 and includes a slot 32, left and right handles 34A,B, and portions of the groove 28 described above. The backrest 18 also sufficient width and depth to support the tool 10 itself and the die assembly 100 in the reclined position without tipping over.

The slot 32 extends vertically (when the tool 10 is in the vertical orientation) on a front face of the backrest 18. The slot 32 guides the slider of the swivel as described below.

The left and right handles 34A,B may be positioned vertically on sides of the backrest 18 and may be integral components or separate fastened pieces. The left and right handles 34A,B may include grip material or geometry for improving a user's grip thereon.

The chamfered surface 20 extends diagonally from the foot to the backrest 18 at an angle of between approximately 1 degree and 89 degrees, more preferably between 20 degrees and 70 degrees, and most preferably between approximately 26 degrees and 60 degrees. The chamfered surface 20 may connect to a bottom surface of the foot 16 via an edge 36 and to the rear surface of the backrest 18 via a filleted surface 38.

The edge 36 may be a well-defined boundary between the chamfered surface 20 and the bottom surface of the foot 16. This allows the tool 10 to be leaned from the upright orientation to the tilted orientation via the edge 36 as a fulcrum. The well-defined boundary facilitates initial leaning to verify that components of the die assembly 100 and tool 10 are well-supported and assembled properly.

The fillet 38 may be a curved surface between the chamfered surface 20 and the rear surface of the backrest 18. This allows the tool 10 to be leaned from the tilted orientation to the reclined orientation via the fillet 38 as a fulcrum. The curvature of the fillet 38 (compared to a well-defined edge) facilities gradual leaning (e.g., rolling) the tool 10 from the tilted orientation to the reclined orientation and from the reclined orientation to the tilted orientation.

The swivel 14 broadly comprises a slider 40, a bearing 42, and a cradle 44. The swivel 14 supports the outer shell 104, female component 106, and male component 108 during maneuvering of these components when the tool 10 is in the reclined orientation. The swivel 14 may also include an adapter for accommodating outer shells of different sizes.

The slider 40 resides in the groove 28 and is configured to translate toward and away from the foot 16 in the groove 28. The slider 40 may be interlocked with the groove 28 so that the slider 40 cannot easily be dislocated from the groove 28.

The bearing 42 pivotably connects the cradle 44 to the slider 40. The bearing 42 may be a ball bearing, fluid bearing, plain bearing, or the like.

The cradle 44 includes left and right arms 46A,B and is pivotably connected to the slider 40 via the bearing 42. The cradle 44 thereby also translates with the slider 40 toward and away from the foot 16.

The left and right arms 46A,B extend laterally outward (when the tool 10 is in the upright orientation) for embracing the outer shell 104. To that end, the left and right arms 46A,B may extend in an arc (in one embodiment, a circular arc), thereby forming a concave surface or other shape complementary to the shape of the outer shell 104.

Use of the tool 10 will now be described in more detail. First, the die assembly 100 may be assembled in an inverted configuration. More particularly, the outer shell 104, female component 106, and male component 108 may be assembled on the base 102 in an inverted orientation (e.g., a material loading orientation). Material may then be loaded into the inner molding chamber 112 (this may require one of the female component 106 and male component 108 to be removed from the outer shell 104).

The tool 10 may then be maneuvered toward the die assembly 100 such that foot 16 (and more particularly, the left and right arms 22A,B of the foot 16) is against the base 102 and such that the backrest 18 is against the outer shell 104, as shown in FIG. 3*a*. The beveled ledge 30 of the foot 16 should engage the bevel 110 of the base 102. A strap may then be inserted into the through-slot 26, passed around the base 102, and cinched or fastened to secure the base 102 to the foot 16.

The rocker 12 (and hence the tool 10 and die assembly 100) may then be leaned from the upright orientation to the tilted orientation via the left and right handles 24A,B and/or the left and right handles 34A,B, as shown in FIG. 3*b*. The rocker 12 may be tilted an initial amount to verify the die assembly 100 is fully supported by the tool 10. In the tilted orientation, the tool 10 should be balanced on the chamfered surface 20. With the tool 10 in the tilted orientation, another strap may be passed in a vertical loop to encircle the tool 10 and die assembly 100 via the slot 32 and cinched or fastened to secure the die assembly 100 to the tool 10.

The rocker 12 (and hence the tool 10 and die assembly 100) may then be leaned from the tilted orientation to the reclined orientation via the filleted surface 38 and via the left and right handles 24A,B and/or the left and right handles 34A,B, as shown in FIG. 3*c*. The outer shell 104 should be resting entirely on the cradle 44 when the rocker 12 is in the reclined orientation. The strap encircling the tool 10 and die assembly 100 may then be at least partially loosened or unfastened.

The slider 40 may then be moved in the groove 28 away from the foot 16 such that the outer shell 104, female component 106, and male component 108 are spaced from the base 102, as shown in FIGS. 3*d*-5. The cradle 44 may then be rotated a half turn via the bearing 42 such that the outer shell 104, female component 106, and male component 108 are in a non-inverted orientation (i.e., a processing orientation) and hence the die assembly 100 is in a non-inverted configuration, as shown in FIG. 6. The slider 40 may then be moved in the groove 28 toward the foot 16 such that the outer shell 104 is against the base 102.

The strap previously encircling the tool 10 and die assembly 100 may then be cinched or fastened again to resecure the die assembly 100 to the tool 10. The rocker 12 (and hence the tool 10 and die assembly 100) may then be leaned from the reclined orientation to the tilted orientation via the filleted surface 38 and via the left and right handles 24A,B and/or the left and right handles 34A,B. The tool 10 and die assembly 100 may then be lifted and carried to a processing machine or other location via the handles 24A,B of the foot 16 and/or the handles 34A,B of the backrest 18. This can be performed by one or two individuals. If two individuals carry the tool 10, it may be more ergonomic for one of the individuals to lift from the left handle 24A and left handle 34A and the other individual to lift from the right handle 24B and right handle 34B. This also has the advantage of approaching the desired location with the lifting individuals on each side of the tool 10.

The rocker 12 (and hence the tool 10 and die assembly 100) may then be leaned from the tilted orientation to the upright orientation via the left and right handles 24A,B and/or the left and right handles 34A,B. The straps may then be removed from the through-slot 26 and slot 32. The tool 10 may then be moved away from the die assembly 100.

The above-described invention provides several advantages. For example, the tool 10 secures the die assembly 100 as the die assembly 100 is leaned to the reclined orientation. The die assembly 100 can be safely switched between its inverted configuration and non-inverted configuration without having to provide a lifting force. The tool 10 does not require cumbersome clamps yet can accommodate die assemblies of different sizes. The tool 10 can also be used to carry the die assembly 100.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A tool for handling a die assembly, the die assembly including at least first and second parts, the tool being moveable between an upright orientation, a reclined orientation, and a tilted orientation, the tool comprising:

a rocker including:

a foot configured to engage the first part when the tool is in the upright orientation and stabilize the die assembly as the tool is leaned from the upright orientation to the reclined orientation via the tilted orientation;

a backrest extending vertically from the foot when the tool is in the upright orientation; and a chamfered surface, the rocker being configured to balance on the chamfered surface to retain the die assembly with the tool in the tilted orientation, wherein the chamfered surface is horizontally-extending and a bottom-most surface of the tool when the tool is in the tilted orientation; and a swivel configured to support the second part on the backrest and to translate and rotate relative to the backrest when the tool is in the reclined orientation to rotate the second part from an inverted orientation to a non-inverted orientation, the foot being further configured to support the die assembly as the tool is leaned from the reclined orientation to the upright orientation via the tilted orientation and to be moved horizontally out of engagement with the first part of the tool when the tool has been returned to the upright orientation.

2. The tool of claim 1, the foot being C-shaped and including a lower beveled ledge for lifting at least one of the first and second parts of the die assembly.

3. The tool of claim 1, the backrest including a filleted surface near the chamfered surface for easing the tool from the tilted orientation to the reclined orientation.

4. The tool of claim 1, the foot and the backrest each including a handle for applying a leveraging force thereto.

5. The tool of claim 1, the backrest including a slot, the swivel including a slider configured to translate in the slot and a cradle configured to rotate relative to the slider.

6. The tool of claim 5, one of the first and second parts of the die assembly being cylindrical, the tool being further characterized in that the cradle includes a cylindrically concave surface for contacting the cylindrical one of the first and second parts of the die assembly.

7. The tool of claim 1, the rocker further comprising a groove extending from the foot to a top of the backrest.

8. The tool of claim 1, the foot further comprising a horizontally-extending through-slot.

9. A tool for handling a die assembly, the die assembly including at least first and second parts, the tool being moveable between an upright orientation, a reclined orientation, and a tilted orientation, the tool comprising:

a rocker including:

a foot configured to engage the first part when the tool is in the upright orientation and stabilize the die assembly as the tool is leaned from the upright orientation to the reclined orientation via the tilted orientation;

a backrest extending vertically from the foot when the tool is in the upright orientation; and a chamfered surface, the rocker being configured to balance on the chamfered surface to retain the die assembly with the tool in the tilted orientation, wherein the chamfered surface is horizontally-extending and a bottom-most surface of the tool when the tool is in the tilted orientation; and a swivel configured to support the second part on the backrest and to translate and rotate relative to the backrest when the tool is in the reclined orientation to rotate the second part from an inverted orientation to a non-inverted orientation.

10. The tool of claim 9, the foot being C-shaped and including a lower beveled ledge for lifting at least one of the first and second parts of the die assembly.

11. The tool of claim 9, the backrest including a filleted surface near the chamfered surface for easing the tool from the tilted orientation to the reclined orientation.

12. The tool of claim 9, the foot and the backrest each including a handle for applying a leveraging force thereto.

13. The tool of claim 9, the backrest including a slot, the swivel including a slider configured to translate in the slot and a cradle configured to rotate relative to the slider.

14. The tool of claim 13, one of the first and second parts of the die assembly being cylindrical, the tool being further characterized in that the cradle includes a cylindrically concave surface for contacting the cylindrical one of the first and second parts of the die assembly.

15. The tool of claim 9, the rocker further comprising a groove extending from the foot to a top of the backrest.

16. The tool of claim 9, the foot further comprising a horizontally-extending through-slot.

17. A tool for handling a die assembly, the die assembly including at least first and second parts, the tool being moveable between an upright orientation, a reclined orientation, and a tilted orientation, the tool comprising:

a rocker including:

a foot configured to engage the first part when the tool is in the upright orientation and stabilize the die assembly as the tool is leaned from the upright orientation to the reclined orientation via the tilted orientation, the foot including a horizontally-extending through-slot;

a backrest extending vertically from the foot when the tool is in the upright orientation, the backrest including a slot, the foot and the backrest each including a handle for applying a leverage force thereto;

a groove extending from the foot to a top of the backrest; and a chamfered surface, the rocker being configured to balance on the chamfered surface to retain the die assembly with the tool in the tilted orientation, wherein the chamfered surface is horizontally-extending and a bottom-most surface of the tool when the tool is in the tilted orientation; and a swivel including a slider, the swivel being configured to support the second part on the backrest and to translate via the slider and rotate relative to the backrest when the tool is in the reclined orientation to rotate the second part from an inverted orientation to a non-inverted orientation, the foot being further configured to support the die assembly as the tool is leaned from the reclined orientation to the upright orientation via the tilted orientation and to be moved horizontally out of engagement with the first part of the tool when the tool has been returned to the upright orientation.

* * * * *